US006668839B2

(12) United States Patent
Williams

(10) Patent No.: US 6,668,839 B2
(45) **Date of Patent: *Dec. 30, 2003**

(54) SMOKELESS TOBACCO PRODUCT

(76) Inventor: Jonnie R. Williams, 1 Starwood La., Manakin-Sabot, VA (US) 23103

( * ) Notice: Subject to any disclaimer, the term of this patent is extended or adjusted under 35 U.S.C. 154(b) by 5 days.

This patent is subject to a terminal disclaimer.

(21) Appl. No.: 09/845,249

(22) Filed: May 1, 2001

(65) Prior Publication Data

US 2002/0162562 A1 Nov. 7, 2002

(51) Int. Cl.[7] ..... A24B 15/00
(52) U.S. Cl. ..... 131/352; 131/347; 131/359
(58) Field of Search ..... 131/364, 347, 131/352, 353, 356–359

(56) References Cited

U.S. PATENT DOCUMENTS

| | | | | | |
|---|---|---|---|---|---|
| 90,301 | A | | 5/1869 | Posada | |
| 179,323 | A | | 6/1876 | Krackowizer | |
| 2,033,791 | A | * | 3/1936 | Sulzberger | 131/52 |
| 2,478,473 | A | | 8/1949 | Eskew | |
| 3,316,919 | A | | 5/1967 | Green et al. | |
| 3,368,567 | A | | 2/1968 | Speer | |
| 3,478,015 | A | | 11/1969 | Onishi et al. | |
| 3,894,543 | A | | 7/1975 | Anderson et al. | |
| 4,271,852 | A | | 6/1981 | Glock | |
| 4,421,126 | A | | 12/1983 | Gellatly | |
| 4,506,682 | A | | 3/1985 | Muller | |
| 4,605,016 | A | | 8/1986 | Soga et al. | |
| 4,802,498 | A | | 2/1989 | Ogren | |
| 4,827,949 | A | | 5/1989 | Sunas | |
| 4,907,605 | A | | 3/1990 | Ray et al. | |
| 4,967,773 | A | | 11/1990 | Shaw | |
| 4,991,599 | A | | 2/1991 | Tibbetts | |
| 5,074,319 | A | | 12/1991 | White et al. | |
| 5,101,839 | A | * | 4/1992 | Jakob et al. | 131/352 |
| 5,135,753 | A | | 8/1992 | Baker et al. | |
| 5,147,654 | A | | 9/1992 | Place et al. | |
| 5,158,771 | A | | 10/1992 | Spindler et al. | |
| 5,244,668 | A | | 9/1993 | Snipes | |
| 5,326,563 | A | | 7/1994 | Spindler et al. | |
| 5,362,496 | A | | 11/1994 | Baker et al. | |
| 5,387,416 | A | | 2/1995 | White et al. | |
| 5,435,325 | A | * | 7/1995 | Clapp et al. | 131/297 |
| 5,512,306 | A | | 4/1996 | Carlsson et al. | |
| 5,525,351 | A | | 6/1996 | Dam | |
| 5,549,906 | A | | 8/1996 | Santus | |
| 5,593,684 | A | | 1/1997 | Baker et al. | |
| 5,594,030 | A | | 1/1997 | Conte et al. | |
| 5,599,554 | A | | 2/1997 | Majeti | |
| 5,612,357 | A | | 3/1997 | Keenan et al. | |
| 5,662,920 | A | | 9/1997 | Santus | |
| 5,783,207 | A | | 7/1998 | Stanley et al. | |
| 5,845,647 | A | * | 12/1998 | O'Donnell et al. | 131/276 |
| 6,135,121 | A | | 10/2000 | Williams | |
| 6,164,287 | A | * | 12/2000 | White | 131/328 |
| 6,202,649 | B1 | | 3/2001 | Williams | |
| 6,280,761 | B1 | | 8/2001 | Santus | |
| 6,358,060 | B2 | | 3/2002 | Pinney et al. | |

FOREIGN PATENT DOCUMENTS

| | | | |
|---|---|---|---|
| WO | WO 00/15056 | * | 3/2000 |

* cited by examiner

*Primary Examiner*—Dionne A. Walls
(74) *Attorney, Agent, or Firm*—Banner & Witcoff, Ltd.

(57) ABSTRACT

A smokeless tobacco product suitable for human consumption can be prepared from an aqueous extract of cured tobacco. In one embodiment, the smokeless tobacco product comprises a solid tablet having at least 50 wt % powdered tobacco. The powdered tobacco preferably consists essentially of Virginia flue tobacco stems. The smokeless tobacco product optionally includes eucalyptus and/or propolis in an amount effective to remove bitterness from said powdered tobacco. The smokeless tobacco product preferably contains powdered tobacco having a collective content of N'-nitrosonornicotine (NNN), 4-(N-nitrosomethylamino)-1-(3-pyridyl)-1-butanone (NNK), N'-nitrosoanatabine (NAT) and N'-nitrosoanabasine (NAB) which is 0.1 $\mu$g/g or less, preferably 0.05 $\mu$g/g or less, more preferably 0.03 $\mu$g/g or less. The powdered tobacco preferably has a content of 4-(N-nitrosomethylamino)-1-(3-pyridyl)-1-butanone (NNK) which is 0.002 $\mu$g/g or less, preferably 0.001 $\mu$g/g or less.

6 Claims, No Drawings

SMOKELESS TOBACCO PRODUCT

BACKGROUND OF THE INVENTION

1. Field of the Invention

The invention relates to an oral smokeless tobacco product and, more particularly, a smokeless tobacco product prepared from a tobacco extract.

2. Description of Related Art

There are many oral delivery forms of tobacco. Such forms include chewing tobacco, chewing gum, lozenges, capsules, and tablets. Chewing tobacco utilizes chopped or shredded tobacco, which is placed in the mouth and ultimately removed from the mouth. Lozenges, tablets, and the like, are often designed to dissolve slowly in order to administer nicotine over a period of time. Such products are often obtained by chopping the tobacco plant or leaf and then extracting soluble components from the tobacco using a solvent. The resulting extract is dried and combined with other ingredients to form the products.

U.S. Pat. No. 3,368,567 describes a tablet having a tobacco concentrate and which is intended to be located in the mouth of the user. In preparing the tablet, nicotine and other active ingredients are extracted from cured tobacco that has been ground into fine particles. The tobacco is steeped in water and then concentrated mineral acid is added. The resulting liquid is applied to an absorbent, inert, edible base, to the extent that it constitutes less than 10% of the base. After the liquid is dried, the resultant material is compressed into a tablet.

U.S. Pat. No. 4,991,599 describes a fiberless tobacco product for smoking or chewing. The fiberless tobacco product is obtained by forming an aqueous extract of the tobacco. Cured tobacco leaves are preferably shredded or comminuted to minute particles, and boiling water or water vapor is passed through the particles to produce an aqueous, fiberless extract of tobacco. The aqueous extract is dried to product a solid extract. The solid then is crushed into smokable or chewable particles.

U.S. Pat. No. 5,387,416 describes extracting cured tobacco leaves with water to form a liquid extract. The liquid extract is concentrated to a solids concentration of about 30% dissolved solids, which is then spray dried to form a spray dried powder. The powder is then dissolved and added to gelatin, for example, and processed to form a tobacco composition that can be placed in the cheek.

Other products utilize a package containing a tobacco product that is placed in the mouth. The tobacco diffuses through the package and the package is ultimately taken out of the mouth and thrown away. Such products include SNOOSE wherein tobacco is placed in a mesh pouch and placed in the mouth. U.S. Pat. No. 4,907,605 directed to using a water-insoluble material (could be similar to a tea-bag) to dispense nicotine in the mouth.

There is a developing market for smoking cessation aids. Most notably have been the transdermal or transmucosal devices to allow delivery of nicotine through the skin or mouth. Other delivery forms include lozenges, tablets, and pills.

U.S. Pat. No. 5,512,306 describes a smoking cessation aid in the form of an inclusion complex formed between nicotine and a cyclo compound such as polysaccharide. U.S. Pat. No. 5,525,351 is directed to a saliva-soluble stimulant formed from a gel and nicotine, while U.S. Pat. No. 5,783,207 describes forming a compressed tablet containing a matrix material and nicotine whereby the compressed tablet is attached to a holder for insertion into the mouth.

U.S. Pat. Nos. 5,135,753; 5,362,496; and 5,593,684, are each directed to the combination of transdermal nicotine delivery along with transmucosal or buccal delivery of nicotine. The latter delivery may be in the form of lozenges, gum, tablets, or capsules.

However, these products suffer in that they deliver a product too high in nitrosamines, which are carcinogens believed to be formed predominantly during curing. The group of nitrosamines identified in tobacco products include tobacco-specific nitrosamines (TSNAs) such as N'-nitrosonornicotine (NNN), 4(N-nitrosomethylamino)-1-(3-pyridyl)-1-butanone (NNK), N'-nitrosoanatabine (NAT) and N'-nitrosoanabasine (NAB). It is believed that nitrosamines may be derived from tobacco alkaloids, of which nicotine is the most prevalent. It has been postulated, according to one group of researchers, that nicotine is nitrosated to form NNN, NNK and/or 4-(N-methyl-N-nitrosamino)-4-(3-pyridyl) butanol (NNA) (Hoffman et al., "Formation, Occurrence, and Carcinogenicity of N-Nitrosamines in Tobacco Products" in O'Neill et al., N-Nitroso Compounds: Occurrence, Biological Effects and Relevance To Human Cancer, World Health Organization, 1984). Hecht et al., "Tobacco specific N-Nitrosamines Occurrence, Carcinogenicity, and Metabolism" Amer. Chem. Soc., 1979, postulated that NNN in unburned tobacco is at levels in the range of 0.3–9.0 ppm in cigarette tobacco, 3.0–45.3 ppm in cigar tobacco, 3.5–90.6 ppm in chewing tobacco, and 12.1–29.1 ppm in snuff. Up to 35 $\mu$g/g of NNK has been detected in tobacco, 0.2–8.3 $\mu$g/g in snuff products, and 0.1–0.5 mg/cig in cigarette smoke.

Generally, high nicotine and nitrosamine contents are found in lamina whereas stems contain lower levels of nicotine and nitrosamines. Stems typically have a nicotine content that is 50% or more lower than the nicotine content in lamina.

SUMMARY OF THE INVENTION

The invention is directed to a smokeless tobacco product made from an extract of cured tobacco. According to one aspect of the invention, a smokeless tobacco product suitable for human consumption comprises a solid tablet having at least 50 wt %, preferably at least 60 wt %, more preferably at least 75 wt %, powdered tobacco, based on the total dry weight of the tablet.

In one preferred embodiment of the invention, the powdered tobacco consists essentially of an extract of tobacco stems. Preferably, the tobacco stems consist essentially of Virginia flue tobacco.

In another preferred embodiment, the smokeless tobacco product includes eucalyptus in an amount effective to remove bitterness from the powdered tobacco.

According to a preferred aspect of the invention, the smokeless tobacco product has a very low nitrosamine content. Preferably the powdered tobacco has a collective content of N'-nitrosonornicotine (NNN), 4-(N-nitrosomethylamino)-1-(3-pyridyl)-1-butanone (NNK), N'-nitrosoanatabine (NAT) and N'-nitrosoanabasine (NAB) which is 0.1 $\mu$g/g or less, preferably 0.05 $\mu$g/g or less, more preferably 0.03 $\mu$g/g or less. Preferably, the powdered tobacco has an NNK content of less than about 0.002 $\mu$g/g, more preferably less than 0.001 $\mu$g/g, and even more preferably less than about 0.0005 $\mu$g/g. Preferably, the powdered tobacco has an NNN content of less than about 0.1 $\mu$g/g, more preferably less than about 0.05 $\mu$g/g, and even more preferably less than about 0.03 $\mu$g/g.

DETAILED DESCRIPTION OF THE INVENTION

The smokeless tobacco product provides an alternative to cigarettes and traditional smokeless products. The product is characterized by a major portion of powdered tobacco and optionally a minor portion of eucalyptus, propolis, spearmint, menthol, and/or other flavorants. The product preferably contains only water-soluble (or saliva-soluble) components, permitting transdermal or transmucosal delivery of nicotine and other components. The product has a very low nitrosamine content, preferably at food-safe levels.

The smokeless tobacco product can be produced by extracting cured tobacco stems with a solvent, typically water or steam. The resulting solution contains the water-soluble components of the tobacco, including nicotine. The solution is then dried and ground, as needed, to form a powdered tobacco and the powdered tobacco is compressed to form a tablet. The tablet is placed in the mouth and allowed to dissolve, releasing the nicotine and other tobacco components. Preferably, eucalyptus is added to eliminate or reduce the bitterness of the final product.

The powdered tobacco of the smokeless tobacco product preferably is formed from cured tobacco stems having very low TSNA content. Tobacco taken from the stem is also known as "hard tobacco." Preferably, flue varieties of tobacco are used, i.e., Virginia flue. Tobacco stems generally have lower nicotine content compared to lamina, typically 50 wt % or more lower than the content found in lamina. Stems also typically have less bitterness than lamina.

First, tobacco is grown and harvested. The tobacco is cured and removed from the curing barn at the end of yellowing. The stem may be separated from the rest of the leaf either before or after curing. Preferably the stem is separated after curing.

Although cured tobacco stems are naturally low in TSNA content, the tobacco preferably is cured using a process designed to obtain very low-TSNA cured tobacco. For example, a microwave process may be used to substantially prevent the formation of nitrosamines during curing. U.S. Pat. No. 5,803,081 and WO 98/05226 describe the use of microwaves to substantially prevent the formation of nitrosamines. Alternatively, tobacco can be cured in a controlled environment that avoids an anaerobic condition, as described in U.S. Pat. No. 6,202,649, to substantially prevent the formation of nitrosamines. U.S. Pat. No. 5,803,081 and U.S. Pat. No. 6,202,649 are hereby incorporated by reference in their entirety.

In accordance with one preferred aspect of the invention, the powdered tobacco product has a collective content of N'-nitrosonornicotine (NNN), 4-(N-nitrosomethyl amino)-1-(3-pyridyl)-1-butanone (NNK), N'-nitrosoanatabine (NAT) and N'-nitroso-anabasine (NAB) which is 0.1 $\mu$g/g or less, preferably less than about 0.09 $\mu$g/g, more preferably less than about 0.07 $\mu$g/g, and even more preferably less than about 0.05 $\mu$g/g, 0.03 $\mu$g/g, 0.015 $\mu$g/g, 0.01 $\mu$g/g, or lower.

After curing, the tobacco stems are preferably subjected to an electron beam. The electron beam destroys any microbes remaining on the tobacco to prevent or substantially prevent the further formation of nitrosamines. U.S. patent application Ser. No 08/998,043, hereby incorporated by reference in its entirety, describes the use of electron beams.

The stem is then chopped or powdered and then subjected to an extraction process with water or other aqueous solvent. With the exception of the pulp, substantially all of the components in tobacco are water-soluble, including components such as nicotine and anti-depressive components such as MAO inhibitors (noricotine, anatabasine, anatabine, etc.).

Methods for forming aqueous tobacco extracts are known in the art as described, for example, in U.S. Pat. No. 5,065,775. In general, tobacco material is contacted with an aqueous solution to extract soluble components. The time of contact will depend on such factors as the water to tobacco ratio and the temperature of the aqueous solution. The aqueous extract produced by contact with the water solution is then separated from the insoluble fibrous tobacco residue, which can be accomplished using conventional solid-liquid separation techniques. For example, squeezing, centrifugation, and filtration techniques may be employed. If necessary, the separated tobacco extract may then be treated to adjust soluble solids content.

More particularly, cured tobacco stems are contacted with an aqueous extraction solvent. Contact can be performed in either a continuous or batchwise manner. The mixture of tobacco stems and extraction solvent can be agitated in order to enhance removal of water-soluble components from the tobacco material. The mixture is subjected to separation conditions (e.g., using a centrifuge) so as to provide an aqueous tobacco extract (i.e., a water-soluble tobacco extract within the extraction solvent), and a water-insoluble tobacco residue.

The aqueous extraction solvent consists primarily of water, normally at least about 90 wt % water, and can be essentially pure water such as deionized water, distilled water, or tap water. The extraction solvent can be a co-solvent mixture, such as a mixture of water and minor amounts of one or more solvents that are miscible therewith. An example of such a co-solvent mixture is a solvent containing 95 parts water and 5 parts ethanol per 100 parts by weight. The extraction solvent also can include water having substances such as pH adjusters (i.e., acids or bases) or pH buffers dissolved therein. For example, an aqueous solvent can have ammonium hydroxide or gaseous ammonia incorporated therein so as to provide a solvent having a pH of about 8 or more.

The amount of tobacco stems which is contacted with the extraction solvent can vary over a wide range and depends upon such factors as the type of solvent, the temperature at which the extraction is performed, the type or form of tobacco stems which is extracted, the manner in which contact of the tobacco stems and solvent is conducted, and the type of extraction process which is performed. Typically, for a batch-wise extraction, the weight of extraction solvent relative to the tobacco stems is greater than about 6:1, oftentimes greater than about 8:1 and in certain instances can be greater than about 12:1. The manner for contacting the tobacco stems with the extraction solvent is not particularly critical, e.g., the tobacco stems can be extracted in either a continuous or batch-wise manner. For example, the tobacco stems can be extracted using a continuous counter-current extractor.

Tobacco stems can be extracted in a batch-wise manner one or more times using the solvent. Normally, the weight of extract and solvent relative to the weight of tobacco material for each batch extraction ranges from about 6:1 to about 40:1, more often from about 15:1 to 25:1. The number of times that the tobacco stems is contacted batch-wise with the processed tobacco extract and solvent ranges from about 1 to about 8 times, more usually from about 3 to 5 times.

The tobacco stems can be extracted continuously. Normally, the weight of aqueous solvent relative to the tobacco material with which it is contacted during a continuous extraction process is greater than about 40:1 and often is greater than about 50:1. The conditions under which the extraction is performed can vary. Typical temperatures range from about 5 to 75° C., more often from about 10 to 60° C. Alternatively, steam can be used to extract the soluble components, which can be recovered in a condenser. The solvent/tobacco material mixture can be agitated (e.g., stirred, shaken or otherwise mixed) in order to increase the rate at which extraction occurs.

Typically, for a batch-wise extraction, adequate extraction of components occurs in less than about 60 minutes, oftentimes in less than about 30 minutes. A wide variety of components can be extracted from the tobacco stems. Water-soluble tobacco components that are extracted from tobacco stems using a solvent having an aqueous character include alkaloids (e.g., nicotine), acids, salts, sugars, and the like. Water-soluble extracted tobacco components include many of the aroma-producing and flavorful substances of the tobacco stems.

Then the solvent and tobacco extract are separated from the insoluble tobacco residue. The manner of separation can vary; however, it is convenient to employ conventional separation techniques involving the use of filters, centrifuges, screw presses, converging belts, rotating disk presses, and the like. The insoluble residue can be treated to remove additional solvent and tobacco extract therefrom.

The solvent and tobacco components extracted thereby optionally can be filtered to remove suspended insoluble particles. In some cases it may be desirable to adjust the pH of the aqueous tobacco extract. For example, as described in U.S. Pat. No. 5,065,775, pH of an aqueous tobacco extract can be raised to promote removal of basic compounds, lowered to promote removal of acidic compounds, or made neutral to promote removal of neutral compounds.

After extraction, the aqueous extract is dried into a powder by any suitable process. Preferably the extract is spray-dried to form a powder. Spray-drying techniques are disclosed, for example, in U.S. Pat. No. 5,387,416, the disclosure of which is hereby incorporated by reference in its entirety. The powder is optionally bleached. In one preferred embodiment, the powder is dried and granulated to maximum particle size of about 12 to about 16 mesh, more usually from about 13 to about 15 mesh.

Preferably, the smokeless tobacco product includes eucalyptus in an amount effective to remove bitterness from the powdered tobacco. The eucalyptus may be provided, for example, by adding leaves of the eucalyptus tree to the tobacco prior to extraction, or by adding eucalyptol to the powdered tobacco. Eucalyptol is a colorless oily liquid, $C_{10}H_{18}O$, derived from eucalyptus leaves. In a preferred embodiment of the invention, the smokeless tobacco product contains from about 5 to about 15 wt %, more usually from about 8 to about 12 wt % eucalyptol, based on the total dry weight of the solid tablet.

In an alternative embodiment, propolis is combined with the powdered tobacco instead of or in addition to eucalyptus. Like eucalyptus, propolis reduces the irritation that can be caused by nicotine in the mouth and enhances the flavor of the powdered tobacco while removing bitterness.

Propolis, also known as bee bread or hive dross, is a resinous substance found in beehives. Bees collect propolis from the outer surface of pollen granules. It has a greenish-brown sticky mass, with an aromatic odor. Its combination with alcohol yields a propolis wax. The propolis is extracted to remove the wax. The residue from the alcohol extraction is called propolis resin, yielding propolis balsam on extraction with hot petroleum ether. Propolis balsam has a hyacinth odor and is said to contain 10% cinnamyl alcohol. Attention is drawn to U.S. Pat. No. 5,845,647, hereby incorporated by reference in its entirety, which describes propolis and its use in tobacco-containing chewing gum and other tobacco products.

An aqueous solution of eucalyptus or propolis may be sprayed onto the tobacco leaf or stem prior to and/or after chopping. Alternatively, eucalyptus or propolis may be added to the liquid extractant after the tobacco is extracted with water or other aqueous solution. Powdered eucalyptus or propolis also may be combined with the powdered tobacco obtained by drying the extractant.

Propolis can be added in an amount effective to provide a less bitter tobacco flavor or to enhance the pleasing tobacco flavor. For example, 1 to 10 ounces of propolis can be added per 100 pounds of tobacco or stems. When spraying a propolis solution on the tobacco stems, the solution typically contains about 0.1% to about 10% propolis by weight in water.

Other ingredients may be added to the powder prior to forming into a tablet. Such ingredients include, but are not limited to flavorants, such as menthol and spearmint. The relative amounts of such other components can vary over a wide range, depending on such factors as the particular tobacco used and consumer preferences. Typically, the amounts of individual components will range from about 1 wt % to about 10 wt %, more usually from about 2 wt % to about 5 wt %, based on the total weight of the powdered tobacco. For example, menthol can be added in an amount of from about 1 wt % to about 5 wt %, more often from about 2 wt % to about 4 wt %.

The powdered tobacco, along with any other ingredients, is compressed into a tablet or pill. The tablet preferably contains at least 50 wt % of powdered tobacco, more preferably at least 60 wt %, and even more preferably at least 75 wt %, and less than 50 wt % of all other ingredients. The weight of the powdered tobacco in the tablet can vary over a wide range, most often from about 75 mg to about 500 mg, more usually from about 100 mg to about 250 mg.

The user consumes the tablet or pill by placing it in the mouth, typically between the cheek and gum. As the pill dissolves, the active tobacco components are dissolved in the saliva. All of the components in the powdered tobacco will transmucously absorb into the mouth or transdermally absorb into the skin.

It will be apparent to those skilled in the art that various modifications and variations can be made in the compositions and methods of the present invention without departing from the spirit or scope of the invention. Thus, it is intended that the present invention cover the modifications and variations of this invention provided they come within the scope of the appended claims and their equivalents.

I claim:

1. An oral smokeless tobacco product suitable for human consumption comprising a solid tablet having at least about 50 wt % powdered tobacco, wherein said powdered tobacco consists essentially of an extract of Virginia flue tobacco stems, wherein said powdered tobacco has a collective content of N'-nitrosonornicotine (NNN), 4-(N-nitrosomethylamino)-1-(3-pyridyl)-1-butanone (NNK), N'-nitrosoanatabine (NAT) and N'-nitrosoanabasine (NAB) which is 0.1 $\mu$g/g or less; the solid tablet optionally further comprising an amount of eucalyptus effective to remove bitterness from the powdered tobacco.

2. The oral smokeless tobacco product of claim 1 wherein said solid tablet comprises at least 60 wt % powdered tobacco.

3. The oral smokeless tobacco product of claim 2 wherein said solid tablet comprises at least 75 wt % powdered tobacco.

4. The oral smokeless tobacco product of claim 1 wherein said collective content is 0.05 $\mu$g/g or less.

5. The oral smokeless tobacco product of claim 4 wherein said collective content is 0.03 $\mu$g/g or less.

6. A solid tablet suitable for human consumption consisting essentially of powdered tobacco and an amount of eucalyptus effective to remove bitterness from said powdered tobacco; wherein said powdered tobacco consists essentially of an extract of Virginia flue tobacco stems; and wherein said powdered tobacco has a collective content of N'-nitrosonornicotine (NNN), 4-(N-nitrosomethylamino)-1-(3-pyridyl)-1-butanone (NNK), N'-nitrosoanatabine (NAT) and N'-nitrosoanabasine (NAB) which is 0.05 $\mu$g/g or less.

* * * * *